US009717283B1

(12) United States Patent
McCalla et al.

(10) Patent No.: US 9,717,283 B1
(45) Date of Patent: Aug. 1, 2017

(54) BODY SLIMMING GARMENT SYSTEM

(71) Applicants: Marcia Maxine McCalla, Long Beach, CA (US); Siona Josiette Riana McCalla, Long Beach, CA (US)

(72) Inventors: Marcia Maxine McCalla, Long Beach, CA (US); Siona Josiette Riana McCalla, Long Beach, CA (US)

( * ) Notice: Subject to any disclaimer, the term of this patent is extended or adjusted under 35 U.S.C. 154(b) by 0 days.

(21) Appl. No.: 15/290,612

(22) Filed: Oct. 11, 2016

(51) Int. Cl.

| | |
|---|---|
| ***A41C 1/00*** | (2006.01) |
| ***A41C 1/08*** | (2006.01) |
| ***A41C 1/12*** | (2006.01) |
| ***A41D 1/18*** | (2006.01) |
| ***A41D 1/22*** | (2006.01) |
| *A41D 1/00* | (2006.01) |

(52) U.S. Cl.
CPC ..... *A41C 1/08* (2013.01); *A41C 1/12* (2013.01); *A41D 1/18* (2013.01); *A41D 1/22* (2013.01)

(58) Field of Classification Search
CPC ..... A41C 1/06; A41C 3/0057; A41C 3/0064; A41C 3/08; A41C 3/148; A41D 13/0525; A61F 13/143
USPC ..... 450/30–33, 28, 7, 8, 18; 2/69, 102, 108; 602/19
See application file for complete search history.

(56) References Cited

U.S. PATENT DOCUMENTS 2,124,769 A * 7/1938 Dubner ..... A41C 1/06 450/9
4,797,954 A * 1/1989 Williams ..... A41B 1/08 2/106
5,351,340 A * 10/1994 Aldridge ..... A41D 13/0525 2/108
5,611,084 A * 3/1997 Garry ..... A41D 13/0525 2/102
5,946,726 A * 9/1999 Green ..... A41C 3/0057 2/102
5,968,003 A * 10/1999 Sisson ..... A41C 3/0064 602/19
6,296,618 B1 * 10/2001 Gaber ..... A61F 13/143 24/442
6,367,086 B1 * 4/2002 Woodard ..... A41D 1/06 2/227
7,909,675 B1 * 3/2011 Rainey ..... A41C 3/02 450/59
8,403,724 B1 * 3/2013 Chapin ..... A41C 3/08 2/106
8,827,764 B2 * 9/2014 Caruso ..... A41B 9/06 450/10

(Continued)

*Primary Examiner* — Gloria Hale
(74) *Attorney, Agent, or Firm* — Mu P.C.

(57) ABSTRACT

In an embodiment, a body slimming garment system comprises a connection strip bonded to an overshirt at the yoke of the overshirt. The connection strip extends and is bonded to an inner belt around the torso of a user. One or more wings are bonded to the posterior of the inner belt extending radially from the user. The inner belt comprises one or more hook-and-eye components and one or more clasp locker components arranged adjacently. A primary wing comprises one or more hook-and-eye components, and one or more clasping lockers on a side of the primary wing. A second side of the primary wing comprises one or more hook-and-eye components and one or more clasping locker components each arranged adjacently. A secondary wing comprises one or more hook-and-eye components and one or more clasp lockers.

5 Claims, 5 Drawing Sheets

(56) References Cited

U.S. PATENT DOCUMENTS

| | | | | |
|---|---|---|---|---|
| 2007/0004314 | A1* | 1/2007 | Carlucci | A41C 3/148<br>450/30 |
| 2008/0134409 | A1* | 6/2008 | Karasina | A41D 1/04<br>2/117 |
| 2008/0244805 | A1* | 10/2008 | Griffin | A41C 1/00<br>2/74 |
| 2015/0208734 | A1* | 7/2015 | Callahan | A41C 3/08<br>450/30 |

* cited by examiner

BODY SLIMMING GARMENT SYSTEM

BACKGROUND OF THE INVENTION

1. Field of Invention

The present invention relates to the field of garment adjusters and more specifically garments designed to constrict the body of the wearer.

2. Description of Related Art

Garments are not only judged by how they look but also by how they fit on the wearer. It is important for the article of clothing to not only look good on the hanger, but to make the wearer look good.

Consumers purchase goods not only out of necessity but also to maintain identity and instill confidence in themselves. Clothing has the ability to convey emotions for both the wearer and those in view of the wearer. Look good—feel good is a common phrase which embodies this principle. To bring this idea to life, many dress for the occasion in order to show social, economic, and emotional status.

Auxiliary articles of clothing have become more and more popular. Currently in the market, there are devices to make the wearer appear taller, such as shoe insert and high heels while pants are also trimmed to make the wearer look taller and thinner. Makeup can be applied to alter the face of the wearer, and insert to almost any imaginable clothing item are available to accentuate various body parts.

For centuries, both men and women have worn corsets. Their purpose is to conform the body to a fashionable silhouette. This ideal figure has not changed much over the years. Classic designs are still in use today, coming in slightly different shapes and sizes depending on the size of the wearer as well as the function desired. Corsets may cover the entire torso or the only the stomach. Some are designed for the hips in order to cinch them to a smaller diameter.

Corsets are not only fashionable, but have medical benefits as well. Persons with scoliosis and other back disabilities can be forced to wear corsets in order to protect the weakened torso. Furthermore, it is common to wear embodiments of the corset in order to make more permanent bodily modifications. Corsets, when worn properly, can slim the waist and stomach if worn for long periods of time.

Modernized versions of the corset also exist to compress the stomach. Current designs in the art are worn under the shirt and are typically made with an elastic material to tighten down on the stomach. These devices are difficult to manage, as one must slip the tube over their head or place their feet through the tube. The wearer then must slide the device to the desired position on the body, which may cause discomfort as struggles ensue.

Further discomfort may be realized in warmer climates as these devices are typically worn under a top layer, the additional layer may cause the wearer to sweat profusely. As the base principle of the device is to instill confidence in the user as well as achieve a more desirable look, it is counterproductive if the wearer is too hot or sweating through their top shirt. It is also not uncommon in conditions such as these for the wearer to develop a rash caused by the friction, heat and moisture produced.

Such devices are not only uncomfortable, but unsightly depending on the top being worn. It is possible that with a top that fits closely to the body, the device will show through the top layer and its presence will be apparent. Clothing does exist which is meant to fit tightly, however these are not as effective as devices such as a corset, which is manually tightened.

Based on the foregoing, there is a need in the art for a body slimming device that is integrated into the clothing, reducing the need for additional layers of clothing. Such a device will have the benefits of a corset without the discomfort and with the added convenience of being integrated into the clothing.

SUMMARY OF THE INVENTION

In an embodiment, a garment integrated body slimming device comprises a connection strip integrally molded to an overshirt. The overshirt may be numerous embodiments of a garment known in the art. In a preferred embodiment, the connection strip is made of nylon and is sewn into the yoke of the shirt. The device is to be worn by a user as one would wear a shirt, dress, blouse, scrub or other top garment and is designed to be discreet.

In an embodiment, the connection strip is sewn or integrally molded into a tightening belt. The tightening belt comprises an inner belt and one or more tightening wings which are affixed to the inner belt.

In a preferred embodiment, the connection strip is made of nylon and integrated into the overshirt such that the device is discreet.

In an embodiment, the one or more wings extend radially from the posterior of the tightening belt in reference to the user. Each wing has the ability to extend around the torso of the user.

In an embodiment, each wing has a plurality of tightening features which are adjustable and selectable by the user. In a specific embodiment, a primary wing comprises a one or more hook-and-eye components and one or more clasping locker components.

In an embodiment, a secondary wing comprises one or more hook-and-eye components and one or more clasping locker components.

In an embodiment, the primary wing further comprises a back-side having on or more corresponding hook-and-eye components and one or more corresponding clasping locker components. Further, each hook-and-eye component is connectable to the corresponding hook-and-eye components and each clasping locker components is connectable to each corresponding clasping locker component.

In an embodiment, the user connects the necessary attachment features of the device and conceals the device under the attached overshirt.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
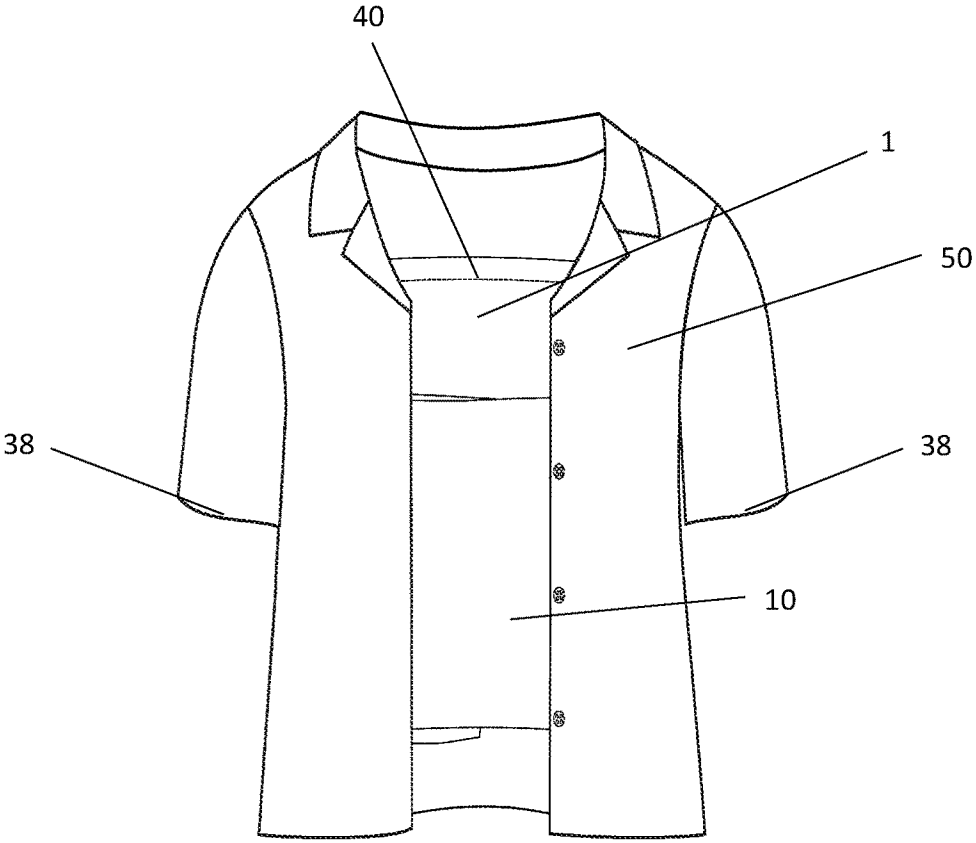
FIG. 1 is a front elevation view of the device, according to an embodiment of the present invention.

Preferred embodiments of the present invention and their advantages may be understood by referring to FIGS. 1-4, wherein like reference numerals refer to like elements.

Described herein is a body slimming garment system in which internal slimming components are integrated into an overshirt. The overshirt may exist as any men's or women's clothing article. In its most simple form, the slimming device within the overshirt consists of a tightening belt, tightening wings, and connection strip. The connection strip is affixed to the overshirt by one of various methods known in the art. The connection strip is attached to the tightening belt. The tightening belt will begin at the sternum, just under the underarms of the user, and extend to the base of the overshirt.

The inner belt fully encircles the user providing an aperture to extend the body through while positioning the device on the body. Further, the suspender straps provide an aperture for the neck of the user as well as opposing apertures on the sides to place the arms through.

In a preferred embodiment, the connection strip is sewn into the overshirt at the yoke of the shirt. Integration to the shirt may be made is a variety of methods known in the art.

In use, the user will place their head through the bottom of the inner belt and up through the shirt as it is typically worn. The user will extend arms out of the arm apertures of an overshirt. The user may wear the overshirt as intended, preferentially ensuring that the inner slimming components are not visible by an outside observer.

In reference to FIG. 1, a body slimming garment system comprises an inner belt 10 encircling the torso of the user. In an embodiment, the inner belt 10 is integrally molded to a connection strip that extends vertically to the yoke of the shirt. The connection strip 1 is integrally molded to the back of the inner belt 10. In a preferred embodiment, the connection strip 1 is integrally molded to an overshirt 50.

The overshirt 50 may be one of numerous men's and women's clothing items including but not limited to a long or short sleeve shirt, blouse, dress, scrubs, and others known in the art. In a preferred embodiment, the inner components of the device, described herein, will be discreetly covered by the overshirt 50 such that the inner components are not visible once the device is properly worn by the user.

In a preferred embodiment, the user will place the garment over the body, as it would typically be worn. For example, the user will extend their head through the aperture 39 of the inner belt 10 and position the device such that their head is through the head aperture 37 of the device. The overshirt 50 will have two apertures for the arms 38 to extend through, as well as a bottom aperture and a top aperture for the neck to extend through.

In an embodiment, the inner slimming components described herein will be integrally attached to the overshirt 50 by the connection strip 1 such that the device is all one piece adding to the convenience of the device.

In a preferred embodiment, the connection strip is made of nylon. The connection strip 1 extends from the yoke of the shirt to the top of the inner belt 10, just below the underarms of the user. The inner belt 10 will extend down to six inches above the bottom of the shirt.

Figure 2:
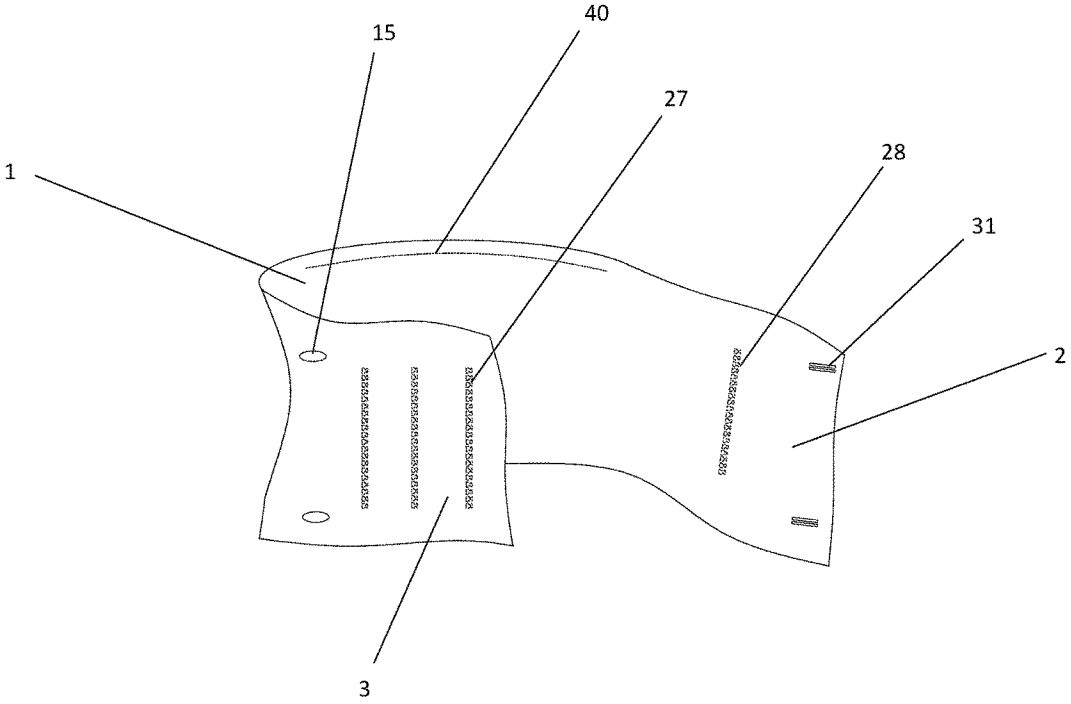
FIG. 2 is a front elevation view of the device, according to an embodiment of the present invention.

In reference to FIG. 2, the inner slimming components of the device are shown. The inner belt 10 will encircle the torso of the user, providing the base for one or more tightening wings 2,3 to attach at the torso of the user. In an embodiment, one or more wings are integrally molded to the rear of the inner belt 10 and extend radially from the user. Each wing 2,3 will have a plurality of attachment features.

In an embodiment, The device is never removable. It is sewn into the overshirt. The connection strip 1 is integrally molded to the undershirt across the yoke of the shirt. Molding may be accomplished by stitching or other means of attachment known in the art. In an alternate embodiment, the device is attachable and removable from the overshirt 50. Further, in a particular embodiment, the connection strip 1 extends down the posterior of the user, providing one or more additional attachment points to the overshirt. As the connection strip 1 extends down the posterior of the wearer, the connection strip 1 connects to the inner belt 10.

In an embodiment, the primary wing 2 extends from the left side of the user and comprises one or more clasping locker components 28 as well as a hook-and-eye component 31. In use, the primary wing will be extended around the torso of the user to the opposing side of the body. The hook-and-eye component 31 will be interlocked with a corresponding hook-and-eye component 16 on the inner belt 10. One or more corresponding hook-and-eye components 16 are positioned on the inner belt 10 allowing for increasing tightness increments. This feature provides multiple levels of restriction or comfort as determined by the user.

In an alternative embodiment, the primary wing 2 extends from the left side of the user and comprises one or more clasping locker components 28 as well as a zipper component 31. In use, the primary wing will be extended around the torso of the user to the opposing side of the body. The zipper component 31 will be interlocked with a corresponding zipper component 16 on the inner belt 10. One or more corresponding zipper components 16 are positioned on the inner belt 10 allowing for increasing tightness increments. This feature provides multiple levels of restriction or comfort as determined by the user.

In use, once the hook-and-eye components are interlocked, the clasping locker component 28 and one of multiple corresponding clasping locker components 41 may be interdigitated. The plurality of corresponding clasping locker components 41 allow for the device to be secured into position and deter disengagement while in use.

In an embodiment, a secondary wing 3 extends from the opposing side of the primary wing 2 and will provide additional tightening of the torso and provide constrictive force for both sides of the user. The secondary wing 3 will comprise a secondary clasping locker component 27 as well as secondary hook-and-eye components 15.

In a preferred embodiment, the inner belt 10 and each wing 2,3 of the device will extend vertically from the sternum to 6 inches above the tail of the overshirt 50. This full extension of the inner belt 10 and wings 2,3 allow for optimal slimming of the torso of the wearer while remaining concealed by the overshirt 50.

Figure 3:
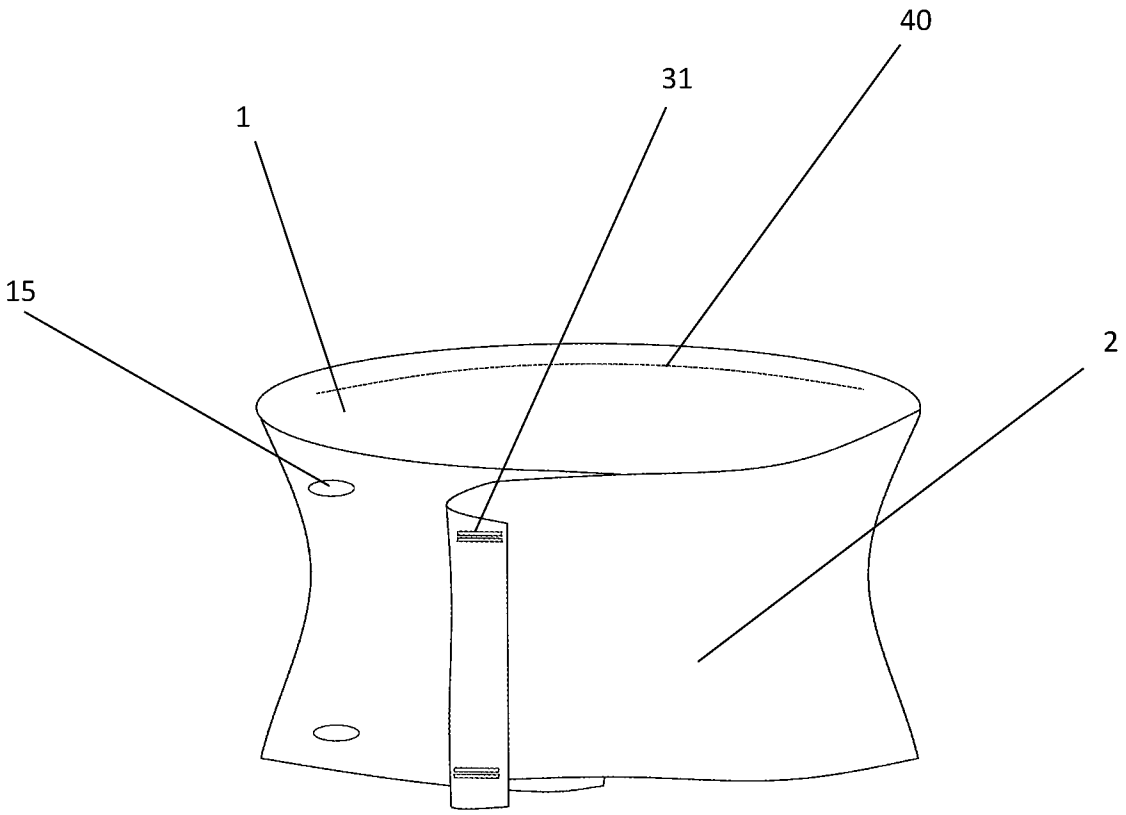
FIG. 3 is a front elevation view of the device, according to an embodiment of the present invention.

In reference to FIG. 3, the device in use is shown in an embodiment of the present design. In use, the primary wing has been engaged with the inner belt 10 to a desired fit as determined by the user. Securing the primary wing reveals additional fastening components on the opposing side of the primary wing surface 2.

In use, the user is now able to pull the secondary wing 3 to the opposing side of the wing and engage with the primary wing 2. The primary wing 2 is revealing a plurality of secondary hook-and-eye components 16 as well as a plurality of secondary clasping locker components 8. In a preferred embodiment, the secondary hook-and-eye components are located at the terminal end of the primary wing 2 and spaced crosswise across the body of the user. Secondary clasping locker components 8 begin at the lateral end of the secondary hook-and-eye components 16 and extend laterally towards the anchor point of the primary wing 2 at the back of the user.

In use, the user will pull the secondary wing 3 and engage one or more secondary hook-and-eye components 16 with the complimentary secondary hook-and-eye components 15 on the secondary wing 3. Once more, the user is able to select from a plurality of attachment features to specify the degree of tightness and comfort desired.

Figure 4:
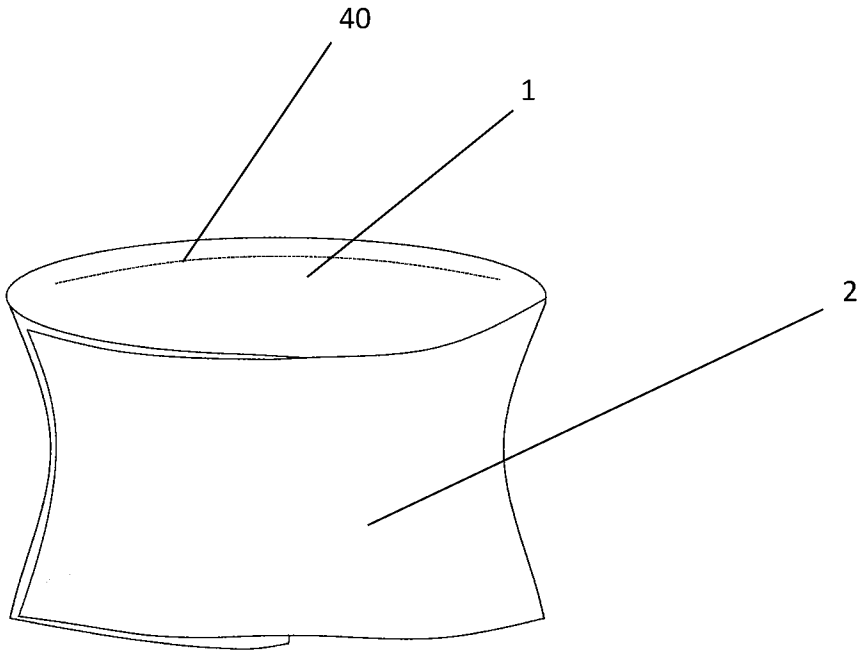
FIG. 4 is a front elevation view of the device, according to an embodiment of the present invention.
Figure 5:
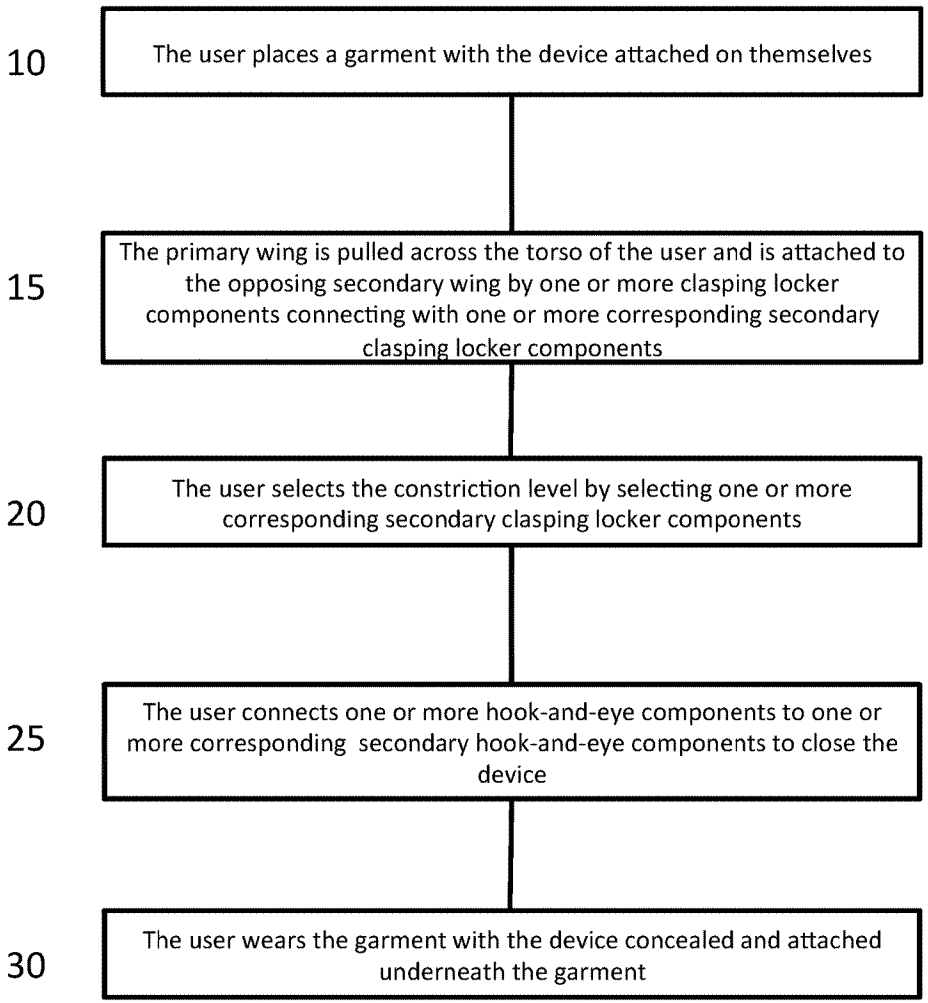
FIG. 5 is a flowchart providing a method of use, according to an embodiment of the present invention.

In reference to FIG. 4, an embodiment of the device is shown while in its functional arrangement. In use, the user has engaged the inner belt 10, primary wing 2, and secondary wing 3. In a preferred embodiment, the totality of the device is concealed under an overshirt in the most discreet manner possible. In a preferred embodiment, the device is not seen by outside observation.

In reference to FIG. 4, a flowchart is shown illustrating a method of use in an embodiment of the present invention. In step 10, the user will place the garment, wherein the device is attached, around oneself per the garments fitting requirements. In step 15, the primary wing is pulled across the torso to engage the corresponding hook-and-loop components, securing the stretched primary wing in place. In step 16 the user connects one or more clasping locker components to on or more corresponding clasping locker components. In step 20, the user pulls the secondary wing across the torso. In step 25, the secondary wing will be able to engage one or more hook and eye attachments depending on the fit desired by the user. In step 30, the clasping lockers are interdigitated to ensure the device does not loosen or become detached during use.

In an embodiment, each hook-and-eye, corresponding hook-and-eye, clasping locker, and corresponding clasping locker may be substituted for other garment attachments known in the art. Adjustability of the device may be modulated to best fit a user or specific application.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. A body slimming garment system comprising:

a. a garment;

b. a body slimmer comprising;

i. a back portion;

ii. a primary wing portion; and iii. a secondary wing portion;

wherein the primary wing portion and the secondary wing portion extend from opposite ends of the back portion, wherein the primary wing portion comprises at least one hook or eye component, wherein the secondary wing portion further comprises at least one corresponding hook or eye component, and wherein the connection strip is bonded to an overshirt, wherein the connection strip is bonded at a yoke of the overshirt.

2. The body slimming garment system of claim 1, wherein the primary and secondary wing are integrally molded to the back portion.

3. The body slimming garment system of claim 2, wherein a connection strip is integrally molded to the primary and secondary wing.

4. The body slimming garment system of claim 1, wherein the one or more primary hook or eye components are positioned at a terminal end of the primary wing.

5. The body slimming garment system of claim 1, wherein a wingset has a plurality of positions;

a. one position wherein the wingset is oriented in an open position; and b. a plurality of positions wherein the wingset is secured to the one or more hook-and-eye, and one or more clasping locker components.

* * * * *